US005356101A

United States Patent [19]

Malloy

[11] Patent Number: 5,356,101

[45] **Date of Patent: * Oct. 18, 1994**

[54] FENCE SUPPORT

[76] Inventor: James T. Malloy, 50 Swede Creek Rd., Oak Run, Calif. 96069

[ * ] Notice: The portion of the term of this patent subsequent to Apr. 14, 2009 has been disclaimed.

[21] Appl. No.: 861,914

[22] Filed: Apr. 1, 1992

Related U.S. Application Data

[63] Continuation-in-part of Ser. No. 370,802, Jun. 23, 1989, Pat. No. 5,104,074.

[51] Int. Cl.[5] ..... F16M 13/00

[52] U.S. Cl. ..... 248/156; 248/545; 248/165; 248/170; 256/63; 256/64; 52/156

[58] Field of Search ..... 248/156, 170, 165, 171; 256/63, 36, 64; 52/158, 156

[56] References Cited

U.S. PATENT DOCUMENTS 542,976 7/1895 Mesnard ..... 52/157 X
5,114,458 12/1893 Riter ..... 256/35

FOREIGN PATENT DOCUMENTS 158396 2/1904 Fed. Rep. of Germany ..... 248/170

*Primary Examiner*—Alvin C. Chin-Shue
*Attorney, Agent, or Firm*—John J. Connors

[57] ABSTRACT

Disclosed is a fence support including a generally vertically oriented main support post in the form of a T shaped iron bar and a single brace. The brace includes an elongated bearing element that is received in the bite of the T and a collar member fits over the top of the main support post and bearing elements to hold them together. The brace has at its bottom end a stake holder which receive a stakes that are driven into the ground. Two different gate adapters are shown for mounting in a hinge like manner a gate to a T-post or the like.

5 Claims, 7 Drawing Sheets

FIG. 1
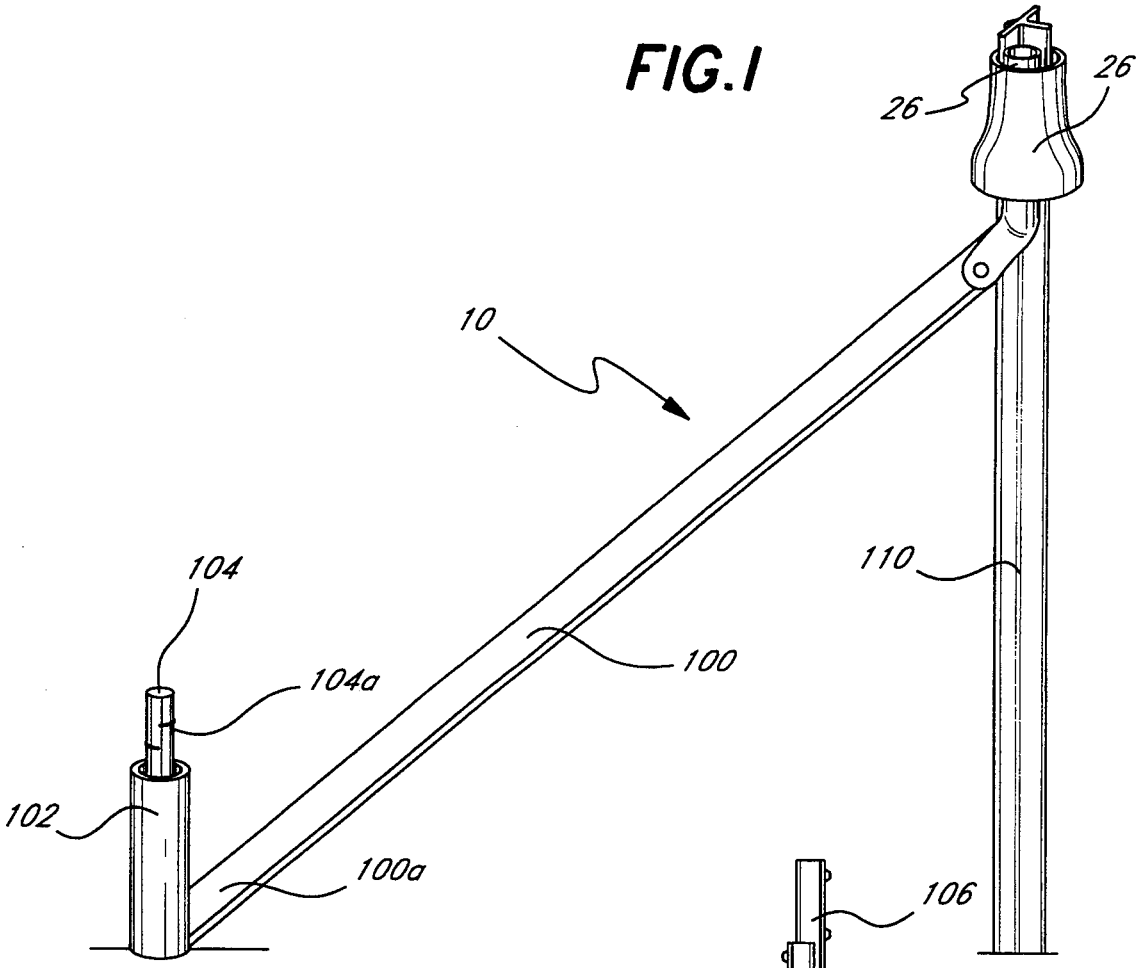
FIG. 2
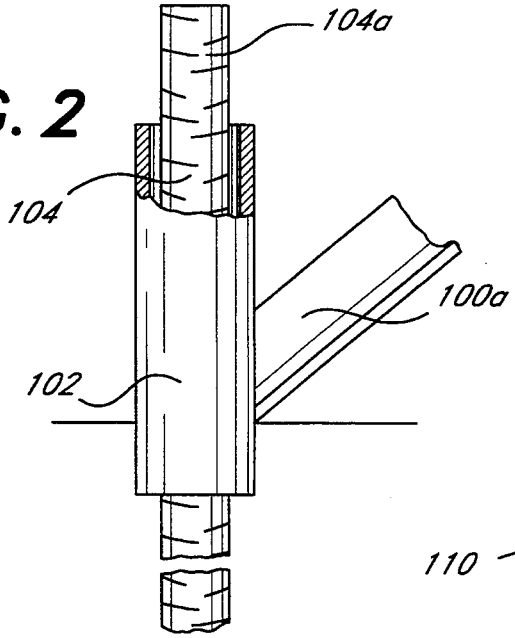
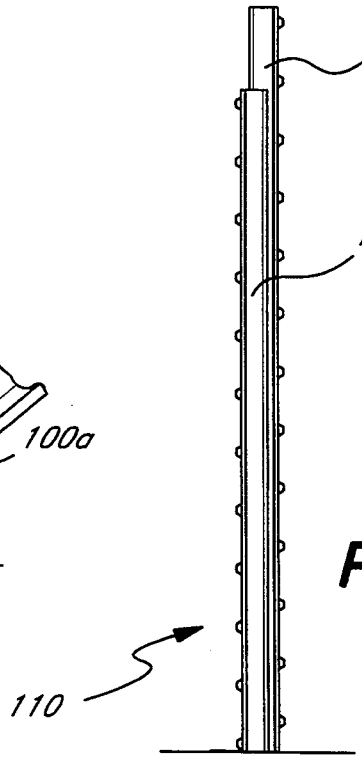
FIG. 3

FIG.13a
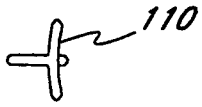
FIG.13b
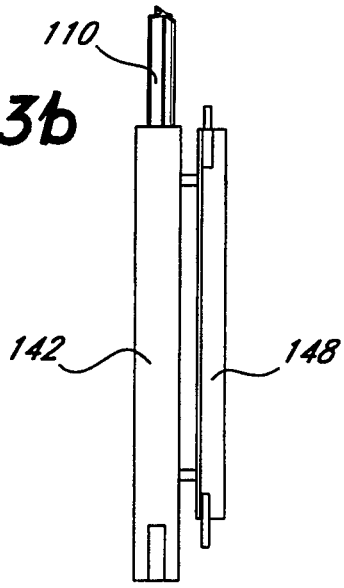
FIG.13c
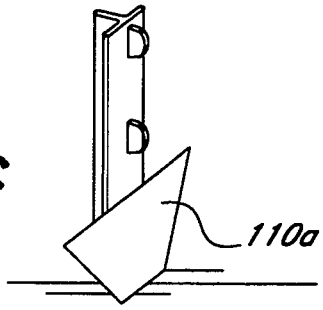
FIG.13d
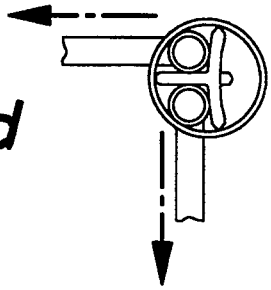
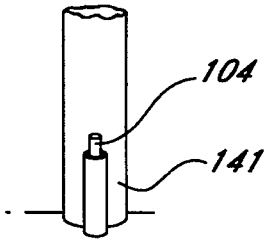
FIG.13e
FIG.13f
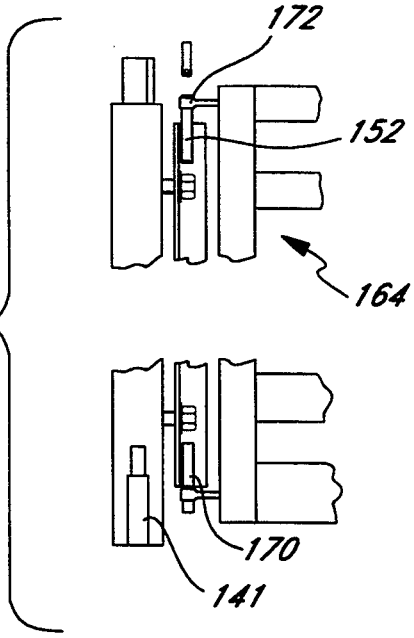

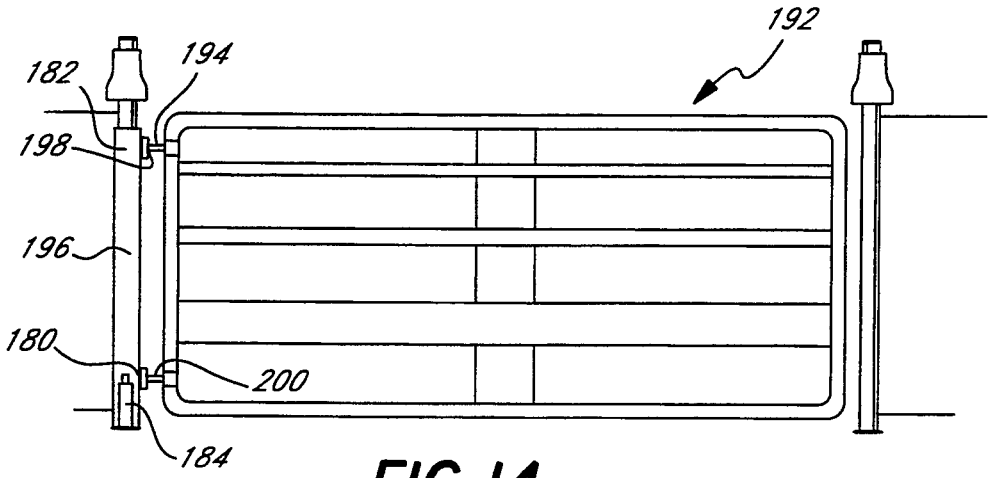
FIG. 14
FIG. 16
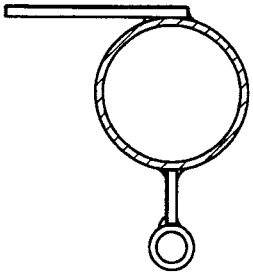
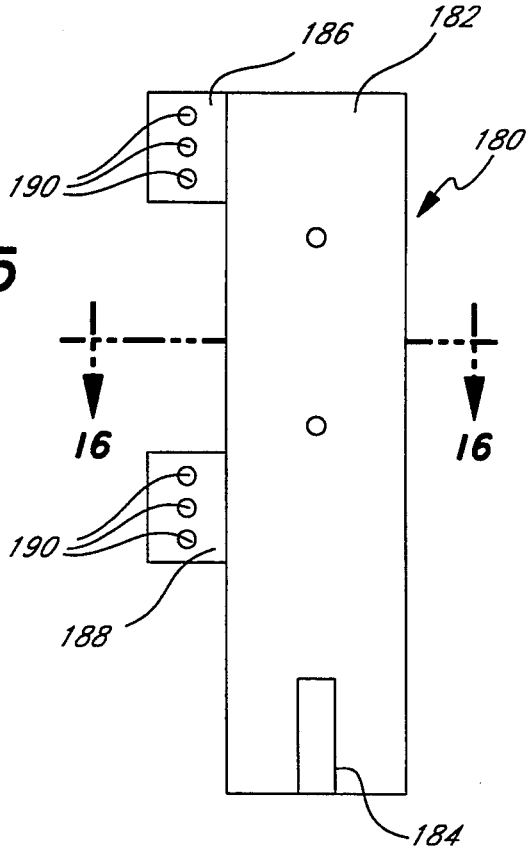
FIG. 15
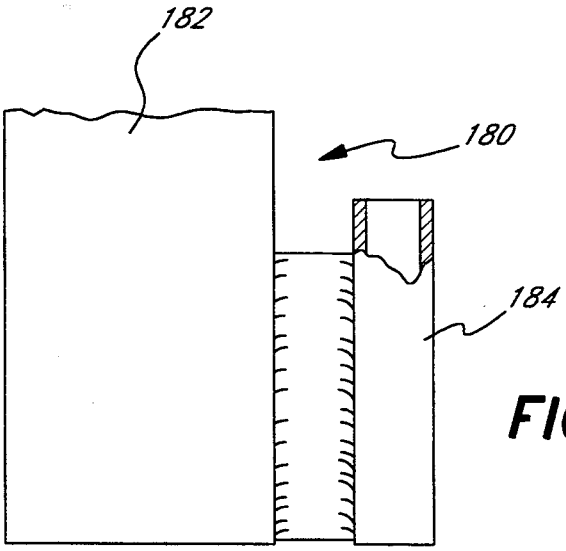
FIG. 17

FENCE SUPPORT

RELATED APPLICATION

This patent application is a continuation-in-part of U.S. patent application Ser. No. 07/370,802, filed Jun. 23, 1989, and entitled Novel Fence Support, which has issued as U.S. Pat. No. 5,104,074. This related patent application is incorporated herein and made a part of this patent application.

BACKGROUND OF THE INVENTION

1. Field of the Invention

This invention relates to a fence support that is inexpensive and may be easily and quickly installed, and to gate adapters for attaching a gate to a T-post.

2. Background Discussion

Typical rural fences consist of a fencing material such as wired type mesh or barbed wire stretched over posts made of wood or metal. These posts are either driven into the ground with sledgehammers or powered or manual drivers, or a hole is dug into the ground, the post is inserted into the hole, and then concrete is poured into the hole and allowed to harden. Installing such fence posts is both laborious and time consuming. For example, it normally takes about an hour to install a post by digging a hole, inserting the post, and pouring in the concrete.

It is sometimes desirable to brace the post using, for example, angle iron, a tee post, or tubing. One end of the brace is bolted to the top of the post and the other end is inserted into a hole in the ground and filled with concrete. A right triangle is formed, with the post and surface of the ground being the legs of triangle and the brace being the hypothenuse. Sometimes the braces pounded into the ground and then bolted or welded to the top of the post. This requires some skill and luck to make the brace intersect the top of the post at the desired position and angle. Frequently, the brace does not end up were desired.

If the post is not in the ground deep enough, or if the ground is soft, for example sandy or wet, the post is pulled from the ground when the fencing material is stretched from the post. The braces remain in place, but the post rises from the ground in much the same way that a pole vaulter is vaulted from the ground when he makes his jump. When this happens there is not a good solution. Typically, sand bags or rocks are placed around the post and positioned to exert a force in a direction opposite to the force being exerted by the stretched fencing material.

SUMMARY OF THE INVENTION

The present invention provides a fence support and a gate adapter which are inexpensive to manufacture, are light weight, are easy to transport to remote locations, and are easily and quickly installed in the field. Typically, an average person can assemble the fence support of this invention within less than five minutes. The support of this invention comes in a kit disassembled, and is assembled in the field to provide a very sturdy support that can withstand very high loads. The ability of the support of this invention to carry high loads is surprising considering that it is so light weight and does not employ and concrete footing like conventional fence posts.

There are several features of this invention, no single one of which is solely responsible for its desirable attributes. Without limiting the scope of this invention as expressed by the claims, its more prominent features will now be discussed briefly. After considering this discussion, and particularly after reading the section of this application entitled "DETAILED DESCRIPTION OF THE PREFERRED EMBODIMENTS," one will understand how the features of this invention provide its advantages.

The first feature of the fence support of this invention is a main support post having a top end and a bottom end adapted to be forced into the ground to orient the main support post generally vertically. The use of an anchor at the bottom of the support post is not required in many applications. The main support post has a predetermined cross-sectional configuration to provide a corner. To provide enhanced strength, the main support post may comprise a pair of T-posts, each T-post having a cross bar and a leg at substantially a right angle to the cross bar. The T-posts are aligned longitudinally, with one T-post being displaced laterally and the legs of the pair of T-posts bearing against each other and being bonded together.

The second feature is a brace having a top end including an elongated bearing element and a bottom end including stake holder means. In the present invention, only one brace is needed for many applications, particularly for intermediate or line support positions along the fence. The elongated bearing element is mounted by hinge means to the top end of the brace. In one embodiment, the elongated bearing element has a pair of mounting members extending outwardly from a lower section. These mounting members are substantially at 90 degrees relative to each other, and hinge means are attached to the each of the mounting members. These mounting members facilitate a four corner construction as will be discussed subsequently.

The third feature is that the main support post and brace are adapted to be assembled into the fence support wherein the top end of the brace engages the top end of the main support post, with the elongated bearing element received in the corner. A collar member force fitted over the top of the main support post and the elongated bearing element, attaching the main support post and elongated bearing element rigidly and fixedly together. Preferably, the elongated bearing element is a tubular member with a side wall that is deformed upon the collar member being force fitted over the top of the main support post and the elongated bearing element.

The fourth feature is that the stake holder means comprises a tubular member oriented generally vertically upon assembly of the main support post and the brace. A stake extends through the tubular member having a first end forced into the ground and second end extending beyond the tubular member. The second end is bent at an acute angle with respect to the vertical.

The fifth feature is a device for mounting a gate to a T-post or the like. There a two version of this device for use with different types of gates commonly in use: a panel gate and a tube gate. each version includes a tubular member adapted to slip over a T-post at the end of the fence at an entryway where the gate is located. This tubular member has a stake holder member near the lower end of the tubular member.

For the panel gate, a bracket is connected to the tubular member, and there is a mounting member near the upper end of the bracket for holding a hinge element. There is a hinge element at the lower end of the bracket secured to said bracket, and a hinged element adapted to be inserted into the mounting member. Preferably, there are means for connecting the bracket and tubular member which are adjustable to change the relative positions of the bracket and tubular member so that the position of the gate relative to the ground is adjustable.

For the tube gate, the gate adapter is of a very simple construction. In addition to the tubular member there are mounting means for attaching in a hinge like manner the gate to the tubular member.

BRIEF DESCRIPTION OF THE DRAWING

The preferred embodiments of this invention illustrating all its features will now be discussed in detail. These embodiments depict the novel and unobvious features of the fence support of this invention. The drawing accompanying this application, which is for illustrative purposes only, includes the following figures wherein like numerals indicate like parts:

FIG. 1 is a perspective view of one embodiment of this invention, using a single brace.

FIG. 2 is an enlarged fragmentary view, partially in cross-section, showing the stake holder of the brace shown in FIG. 1.

FIG. 3 is a side-elevational view of the main support post used in the embodiment shown in FIG. 1.

FIGS. 13*a* through 13*f* is a schematic illustration of the installation instructions for the gate adapter shown in FIG. 9.

FIG. 14 is an alternate embodiment of a gate adapter.

FIG. 15 is a side elevational view of the alternate gate adapter depicted in FIG. 14.

FIG. 16 is a cross-sectional view taken along line 16—16 of FIG. 15.

FIG. 17 is an enlarged fragmentary view, partially in section, of the lower portion of the gate adapter shown in FIG. 15.

DETAILED DESCRIPTION OF THE PREFERRED EMBODIMENTS

FIGS. 1 through 5

Figure 4:
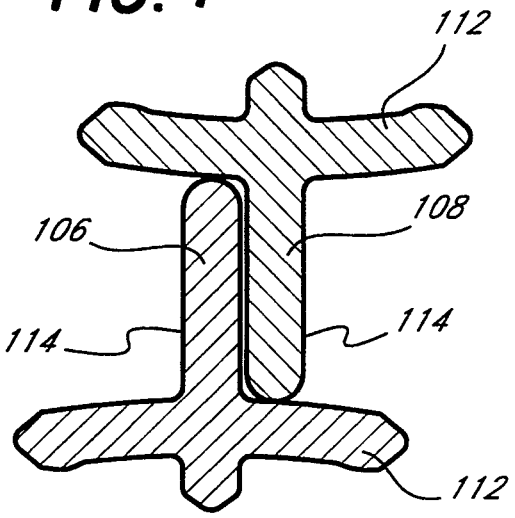
FIG. 4 is a cross-sectional view taken along line 4—4 of FIG. 3.
Figure 5:
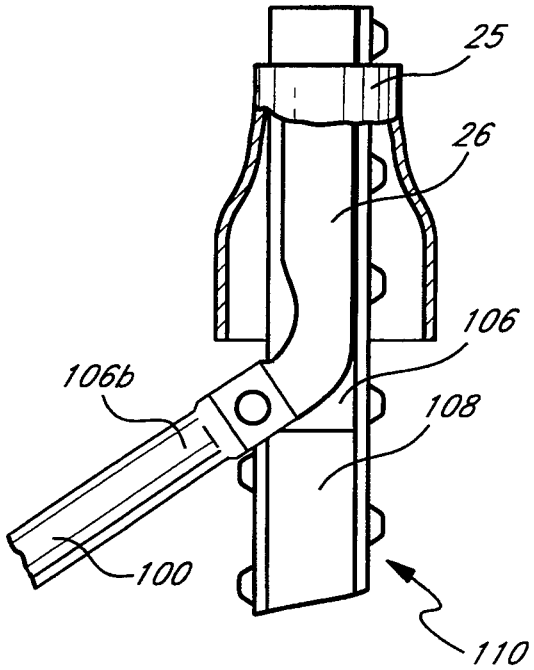
FIG. 5 is a enlarged fragmentary view, partially in cross section, showing the assembly of the brace, collar member, and main support of the embodiment shown in FIG. 1.

FIGS. 1 through 5 show one embodiment of the fence support 10 of this invention, employing a single brace 100. This brace 100 has at its lower end 100*a* a tubular stake holder 102 comprising a tubular element welded to the lower end of the brace. As best shown in FIG. 5, a bearing element 26 is attached by a hinge 52 to the upper end 100*b* of the brace 100. The stake holder 102 is generally vertically oriented when the fence support 10 is assembled (as shown in FIG. 1). A stake 104 is driven into the ground, first passing through the tubular stake holder 102. In accordance with this invention, the stake 104 has its exposed end 104*a* bent at approximately an angle from 18° to 45°, which provides an interference fit with the inside of the stake holder 102, as illustrated in FIG. 2.

As depicted in FIGS. 3 and 4, a pair of T-posts 106 and 108 are welded together to form a sturdy main support post 110. Each T-post 106 and 108 has a crossbar 112 and a leg 114, and the legs are juxtaposed and welded together. The T-posts are offset lengthwise relative to each other, so that the upper end of main support post 110 comprises only the upper section of the T-post 106. This allows the bearing element 26 to fit between the corner formed by the crossbar 112 and leg 114 of the T-post 106, as shown in FIG. 17.

Figure 6:
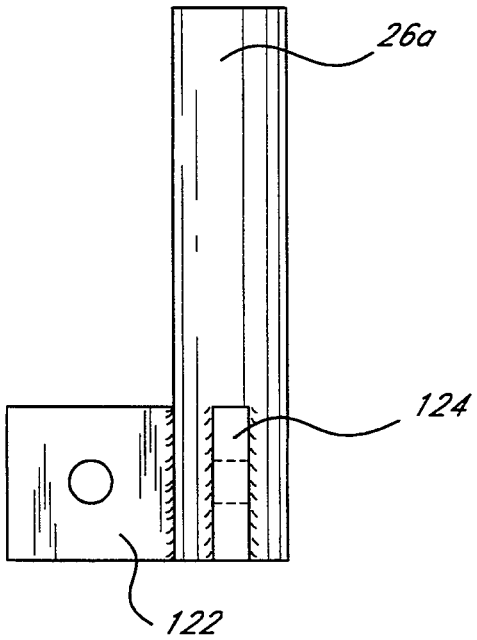
FIG. 6 is a side elevational view of the bearing element of an alternate embodiment of the brace shown in FIG. 1.
Figure 7:
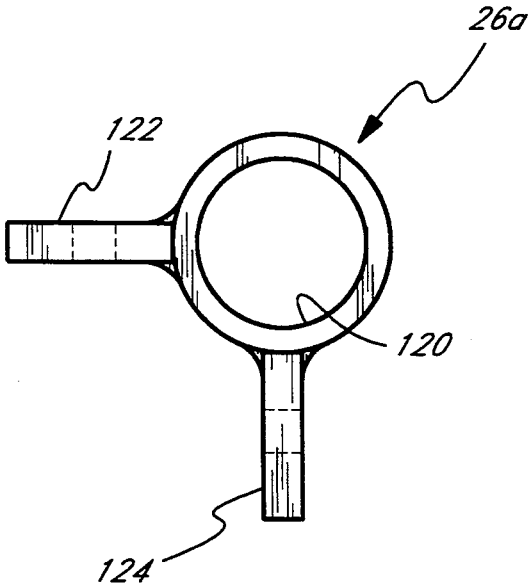
FIG. 7 is a cross-sectional view taken along line 7—7 of FIG. 6.
Figure 8:
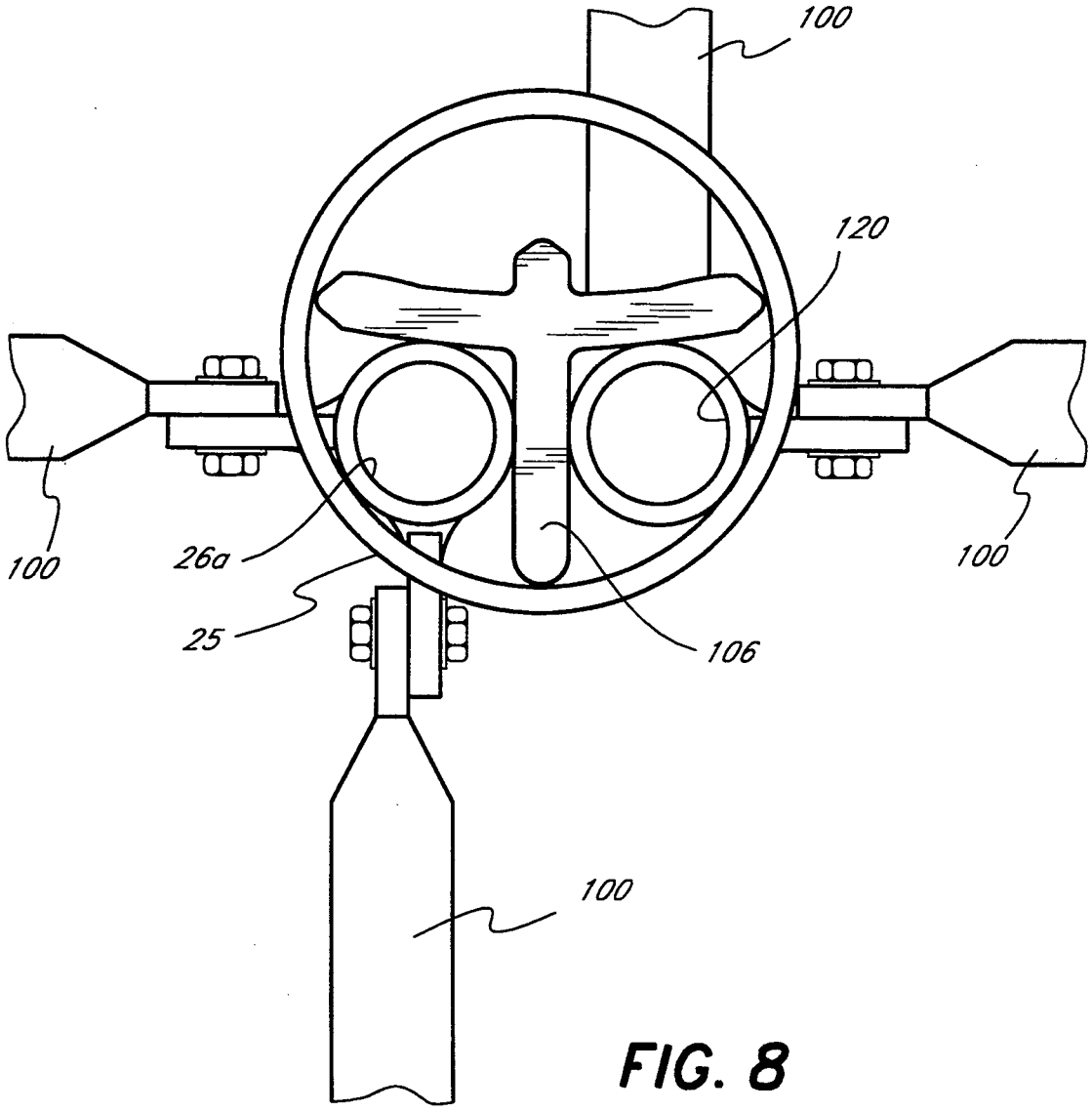
FIG. 8 is a top cross-sectional view of an assembly of a T-post and two braces and four braces, using the bearing elements shown in FIG. 6 and 7.
Figure 9A:
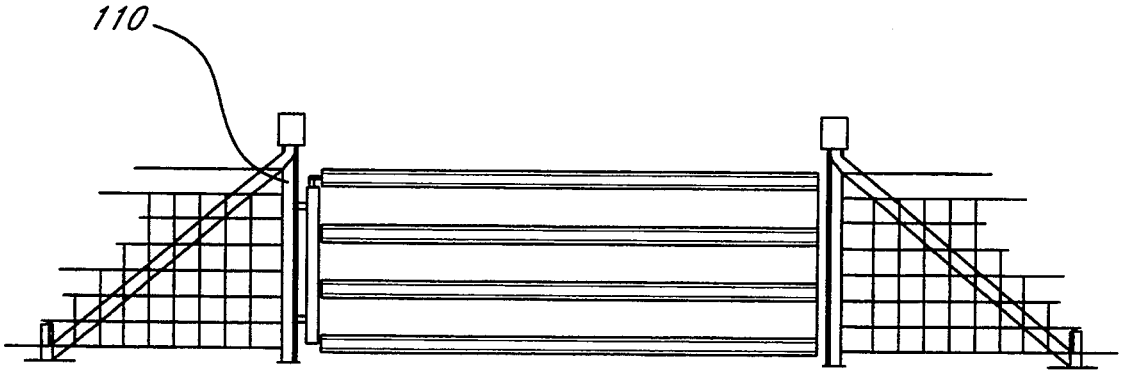
FIG. 9*a* is a front elevational view of a gate using a novel panel gate adapter of this invention.
Figure 9B:
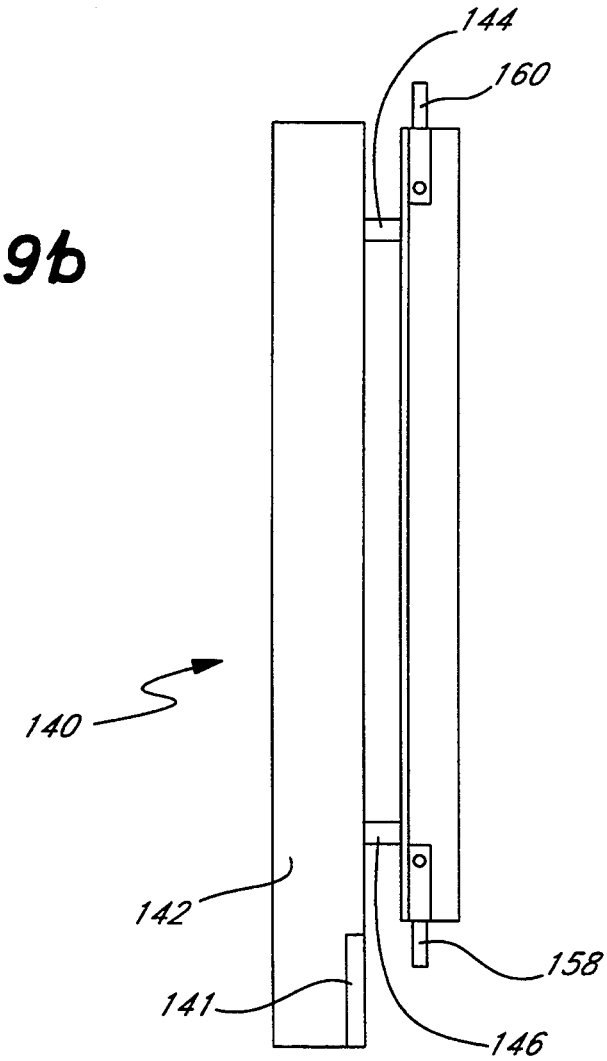
FIG. 9*b* is a front elevational view of the gate adapter.

FIGS. 6 through 8

FIGS. 6 through 8 illustrate an embodiment where the bearing element 26*a* is made of a tubular structure which has a relatively thin wall 120 that is deformed and crushed when the collar 25 is force-fitted over the assembly of the brace 100, bearing element 26*a*, and collar 25. In accordance with another feature of this invention, the bearing element 26*a* may have at its lower end two mounting plates 122 and 124. These mounting plates 122 and 124 are welded to the lower portion of the bearing member 26*a*, and are disposed generally at right angles to each other. As depicted in FIG. 8, this permits a fence to be joined at four corners through assembling two of these bearing elements 26*a* connected to braces 100 in a common assembly and held in position by a single collar 25.

FIGS. 9 through 13

Figure 10:
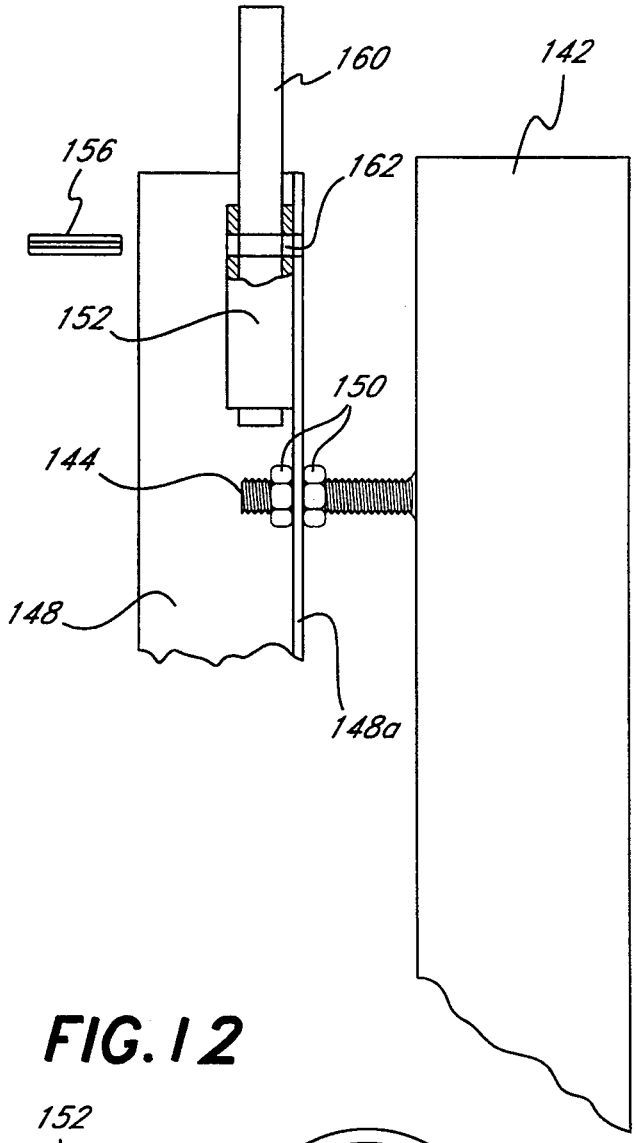
FIG. 10 is an enlarged fragmentary view, partially in cross section, showing the adapter depicted in FIG. 9.
Figure 11:
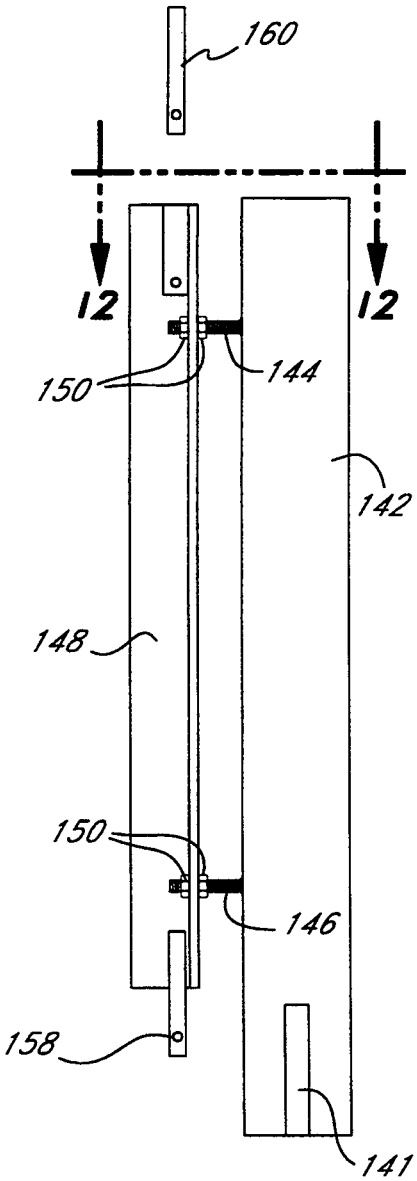
FIG. 11 is a side elevational view of the adapter shown in FIG. 10.
Figure 12:
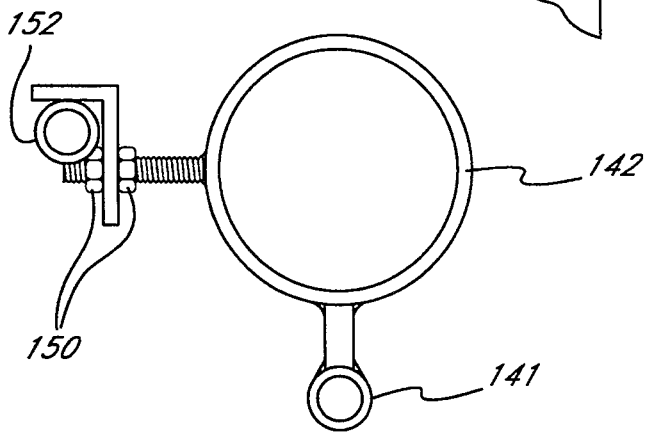
FIG. 12 is a cross-sectional view taken along line 12—12 of FIG. 11.

FIGS. 9 through 13 illustrate a unique gate adapter 140 particularly suited for use with a panel gate 164. This gate adapter 140 includes a hollow tubular member 142 having two threaded screw elements 144 and 146 extending outwardly from the tubular member's lower and top ends, respectfully. The tubular member 142 is slipped over the T-post 110, as discussed in U.S. patent application Ser. No. 07/370,802. At the lower end of the tubular member is a stake holder 141. A generally L-shaped angle bracket 148 is attached by nuts 150 to the screw elements 144 and 146. At the upper end of the L-shaped angle bracket is a tube 152 welded to one leg 148*a* of the L-shape bracket 148. As best illustrated in FIG. 10, there is a hole 154 drilled through the tube 152 and through the leg 148*a* which accommodates a roll pin 156. There is a stud 158 welded in place at the lower end of the leg 148*a* and a stud 160 which drops into the open end of the tube 152. The stud 160 has a traverse orifice 162 through which the roll pin 156 passes upon assembly.

The assembly of the panel gate 164 and gate adapter 140 is illustrated in FIGS. 13*a –f*. In step 1(FIGS. 13*a*), at the end of the fence line a T-post 110 is driven into the ground. Initially, the butterfly spade 110*a* at the end of the T-post 110 is above ground. In step 2(FIG. 13*b*), the tubular member 142 is slipped over the T-post 110, and in step 3(FIGS. 13*c* and 13*d*), the T-post is properly braced as discussed in U.S. patent application Ser. No. 07/370,802. In step 4(FIG. 13*e*), a stake 104 is placed in the stake holder 141 and driven into the ground. In step 5(FIG. 13*f*), the bottom stud 158 is slipped into a hinge receptacle 170 on the lower end of the gate 164, and the tube 152 is aligned with an upper hinge receptacle 172 on the upper end of the gate. The stud is slipped through the upper hinge receptacle 172 which is open at both ends into the tube 152, and tapped into place using a hammer. In step 6(FIG. 13*f*), the nuts 150 are adjusted to level and properly position with respect to the ground.

FIGS. 14 through 17

FIGS. 14 through 17 depict an alternate embodiment 180 of the gate adapter for use with a tube gate 192. This gate adapter 180 includes a tubular member 182 with a stake holder 184 near its lower end. A pair of plates 186 and 188 extend outward from near the top and bottom, respectively, of the tubular member 182. These plates 186 and 188 each have three holes 190 drilled through the plates. This adapter 180 is designed to be used with a gate 192 already having a conventional hinge mechanism 194 attached to it. This hinge mechanism has a bracket 196 with threaded studs 198 and 200 extending outward in a vertical direction. There are two nuts (not shown) on each stud 198 and 200. One on the outer nuts are removed and the ends of the studs are inserted into one of the holes in the plates 186 and 188 and reattached. The nuts are adjusted to correctly position the gate 192.

SCOPE OF THE INVENTION

The above description presents the best mode contemplated of carrying out the present invention. This invention is, however, susceptible to modifications and alternate constructions from the embodiments shown in the drawing and described above. Consequently, it is not the intention to limit this invention to the particular embodiments disclosed. On the contrary, the intention is to cover all modifications coming within the spirit and scope of the invention as generally expressed in the following claims.

I claim:

1. A fence support comprising a main support post having a top end and a bottom end adapted to be forced into the ground to orient the main support post generally vertically, said. main support post having a predetermined cross-sectional configuration to provide a corner, a brace having a top end including an elongated bearing element and a bottom end including stake holder means, said elongated bearing element being mounted by hinge means to the top end of the brace, said main support post and brace being adapted to be assembled into said fence support wherein the top end of the brace engages the top end of the main support post, with said elongated bearing element received in said corner, and a collar member force fitted over the top of the main support post and the elongated bearing element, attaching said main support post and elongated bearing element rigidly and fixedly together.

2. The fence support of claim 1 wherein the stake holder means comprises a tubular member oriented generally vertically upon assembly of the main support post and the brace, and a stake extends through the tubular member having a first end forced into the ground and second end extending beyond the tubular member, said second end being at an acute angle with respect to the vertical.

3. The fence support of claim 1 where the elongated bearing element is a tubular member with a side wall that is deformed upon the collar member being force fitted over the top of the main support post and the elongated bearing element.

4. The fence support of claim 1 where the elongated bearing element has a pair of mounting members extending outwardly from a lower section, said mounting members being substantially at 90 degrees relative to each other, and the hinge means being attached to the mounting members.

5. The fence post of claim 1 where the main support post comprises a pair of T-posts, each T-post having a cross bar and a leg at substantially a right angle to the cross bar, said T-posts being aligned longitudinally, with one T-post being displaced laterally and the legs of the pair of T-posts bearing against each other and being bonded together.

* * * * *